US009188907B1

(12) United States Patent
Bennett, III et al.

(10) Patent No.: US 9,188,907 B1
(45) Date of Patent: Nov. 17, 2015

(54) END SEALING AND MAGNETIC FIELD TRUNCATION OF A MAGNETIC ROLL OF A DUAL ELECTROPHOTOGRAPHIC IMAGE FORMING DEVICE

(71) Applicant: Lexmark International, Inc., Lexington, KY (US)

(72) Inventors: Robert Dan Bennett, III, Paris, KY (US); Gary Allen Denton, Lexington, KY (US); Katherine Marie Gilliam, Lexington, KY (US); Elliott Vincent Jernigan, Lexington, KY (US); Matthew Lee Rogers, Lexington, KY (US); Dominique Renee Rowe, Lexington, KY (US); Daniel Enrique Alonzo, Manvel, TX (US); Royden Thomas Kern, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 14/536,800

(22) Filed: Nov. 10, 2014

Related U.S. Application Data

(63) Continuation of application No. 14/501,807, filed on Sep. 30, 2014.

(51) Int. Cl.
*G03G 15/09* (2006.01)

(52) U.S. Cl.
CPC ..... *G03G 15/0942* (2013.01); *G03G 15/0928* (2013.01)

(58) Field of Classification Search
CPC ..... G03G 15/0817; G03G 15/0898; G03G 15/0942
USPC ..... 399/103, 104
See application file for complete search history.

(56) References Cited

U.S. PATENT DOCUMENTS

| | | | | |
|---|---|---|---|---|
| 4,101,211 | A * | 7/1978 | Kayson | 399/104 |
| 5,177,536 | A | 1/1993 | Watanabe et al. | |
| 5,293,199 | A | 3/1994 | Saito et al. | |
| 8,500,615 | B2 | 8/2013 | Imamura et al. | |
| 2007/0122183 | A1 | 5/2007 | Kawai | |
| 2008/0199210 | A1 | 8/2008 | Inaba et al. | |
| 2010/0008702 | A1 * | 1/2010 | Park | 399/274 |
| 2011/0222919 | A1 * | 9/2011 | Takemoto | 399/273 |
| 2011/0229189 | A1 | 9/2011 | Okuno | |
| 2011/0255897 | A1 | 10/2011 | Sato | |
| 2012/0148313 | A1 | 6/2012 | Nose et al. | |
| 2013/0051842 | A1 * | 2/2013 | Nose | 399/104 |

OTHER PUBLICATIONS

U.S. Appl. No. 14/501,807, filed Sep. 30, 2014.

* cited by examiner

*Primary Examiner* — Sophia S Chen
(74) *Attorney, Agent, or Firm* — Justin M Tromp

(57) ABSTRACT

A developer unit according to one example embodiment includes a housing having a reservoir for storing a developer mix that includes toner and magnetic carrier beads. A magnetic roll includes a stationary core and a sleeve positioned around the core that is rotatable relative to the core. The stationary core includes at least one permanent magnet having circumferentially spaced magnetic poles. An upper and a lower magnetically permeable metal shunt are positioned at each axial end of the magnetic roll. Each upper shunt and each lower shunt is positioned axially outboard of the core and in close proximity to the outer surface of the sleeve. A combination of the upper shunt and the lower shunt at each axial end of the magnetic roll surrounds greater than 180 degrees of the outer surface of the sleeve.

25 Claims, 9 Drawing Sheets

END SEALING AND MAGNETIC FIELD TRUNCATION OF A MAGNETIC ROLL OF A DUAL ELECTROPHOTOGRAPHIC IMAGE FORMING DEVICE

CROSS REFERENCES TO RELATED APPLICATIONS

This patent application is a continuation application of U.S. patent application Ser. No. 14/501,807, filed Sep. 30, 2014, entitled "Partial Internal Shunt and Partial External Shunt Assembly for a Magnetic Roll of a Dual Component Development Electrophotographic Image Forming Device."

BACKGROUND

1. Field of the Disclosure

The present disclosure relates generally to image forming devices and more particularly to end sealing and magnetic field truncation of a magnetic roll of a dual component development electrophotographic image forming device.

2. Description of the Related Art

Dual component development electrophotographic image forming devices include one or more reservoirs that store a mixture of toner and magnetic carrier beads. Toner is electrostatically attracted to the carrier beads as a result of triboelectric interaction between the toner and the carrier beads. A magnetic roll includes a stationary core having one or more permanent magnets and a sleeve that rotates around the core. The magnetic roll attracts the carrier beads in the reservoir having toner thereon to the outer surface of the sleeve through the use of magnetic fields from the core. A photoconductive drum in close proximity to the sleeve of the magnetic roll is charged by a charge roll to a predetermined voltage and a laser selectively discharges areas on the surface of the photoconductive drum to form a latent image on the surface of the photoconductive drum. The sleeve is electrically biased to facilitate the transfer of toner from the mix of toner and carrier beads on the outer surface of the sleeve to the discharged areas on the surface of the photoconductive drum forming a toner image on the surface of the photoconductive drum. The photoconductive drum then transfers the toner image, directly or indirectly, to a media sheet forming a printed image on the media sheet.

In general, the sleeve of the magnetic roll has a greater axial length than the core such that axial end portions of the sleeve extend past both axial ends of the core. The magnetic field lines from the core extend past the axial ends of the core and attract fine amounts of carrier beads and toner to the surface of the sleeve past the axial ends of the core. Toner from the surface of the sleeve past the axial ends of the core is generally not dense enough to form full quality images on the surface of the photoconductive drum. Accordingly, transfer of toner from the surface of the sleeve past the axial ends of the core to the surface of the photoconductive drum at the outer axial portions of the photoconductive drum is undesired.

The presence of unwanted carrier beads and toner on the surface of the sleeve past the axial ends of the core also increases the risk of leakage of carrier beads and toner from the system. During operation, carrier beads and toner may tend to accumulate on the outer axial end portions of the sleeve and leak past the axial ends of the sleeve potentially contaminating other parts of the system. Carrier beads and toner may also leak past the axial ends of the sleeve if a unit containing the reservoir and the magnetic roll is accidentally dropped during shipment of the unit.

One method to reduce the unwanted transfer of toner from the surface of the sleeve past the axial ends of the core to the surface of the photoconductive drum includes extending the length of the photoconductive drum and the charge roll in order to charge the surface of the photoconductive drum at the outer axial ends of the photoconductive drum to a voltage that will resist the charged toner. However, increasing the length of the photoconductive drum and the charge roll increases the cost and size of the system and does not address the leakage risk.

Another method to reduce the unwanted transfer of toner from the surface of the sleeve past the axial ends of the core to the surface of the photoconductive drum includes placing a magnetic shunt in the shape of a circular washer on a shaft of the magnetic roll and against each axial end of the core inside of the sleeve. This type of magnetic shunt is referred to as an internal shunt because it is positioned inside of the sleeve. Each internal magnetic shunt extends to the outer radial edge of the core around the entire circumference of the core. Each internal magnetic shunt is composed of a magnetically permeable metal that redirects the magnetic field lines from the axial ends of the core back into the core to decrease the distance that the magnetic field lines extend axially past the core. As a result, the internal magnetic shunts reduce the amount of carrier beads and toner on the surface of the sleeve past the axial ends of the core. However, these internal magnetic shunts do not address the leakage risk.

Accordingly, an improved method to reduce the amount of carrier beads and toner on the surface of the sleeve of a magnetic roll past the axial ends of the core of the magnetic roll and to reduce carrier bead and toner leakage is desired.

SUMMARY

A developer unit for a dual component development electrophotographic image forming device according to one example embodiment includes a housing having a reservoir for storing a developer mix that includes toner and magnetic carrier beads. A magnetic roll includes a stationary core and a sleeve that is positioned around the core and rotatable relative to the core about an axis of rotation. The stationary core includes at least one permanent magnet having a plurality of circumferentially spaced magnetic poles. An outer surface of the sleeve is positioned to carry developer mix attracted to the outer surface of the sleeve by the at least one permanent magnet from the reservoir through an exposed portion of the magnetic roll where the magnetic roll is exposed for transfer to a photoconductive drum and back to the reservoir. An upper shunt and a lower shunt are positioned at each axial end of the magnetic roll. Each upper shunt and each lower shunt is positioned axially outboard of the core and in close proximity to the outer surface of the sleeve. Each upper shunt is positioned along an upper circumferential portion of the outer surface of the sleeve and each lower shunt is positioned along a lower circumferential portion of the outer surface of the sleeve. Each upper and lower shunt is composed of a magnetically permeable metal. A combination of the upper shunt and the lower shunt at each axial end of the magnetic roll surrounds greater than 180 degrees of the outer surface of the sleeve.

A developer unit for a dual component development electrophotographic image forming device according to another example embodiment includes a housing having a reservoir for storing a developer mix that includes toner and magnetic carrier beads. A magnetic roll includes a stationary core and a sleeve that is positioned around the core and rotatable relative to the core about an axis of rotation. The stationary core includes at least one permanent magnet having a plurality of circumferentially spaced magnetic poles. An outer surface of the sleeve is positioned to carry developer mix attracted to the outer surface of the sleeve by the at least one permanent magnet from the reservoir through an exposed portion of the magnetic roll for transfer to a photoconductive drum and back to the reservoir. An upper shunt and a lower shunt are positioned at each axial end of the magnetic roll. Each upper shunt and each lower shunt is positioned axially outboard of the core and in close proximity to the outer surface of the sleeve. Each upper shunt is positioned along an upper circumferential portion of the outer surface of the sleeve and each lower shunt is positioned along a lower circumferential portion of the outer surface of the sleeve. Each upper and tower shunt is composed of a magnetically permeable metal. A starting point of each upper shunt relative to an operative rotational direction of the sleeve is positioned circumferentially between a pair of poles of the plurality of circumferentially spaced magnetic poles where a magnetic field from the at least one permanent magnet is more tangential than radial. An ending point of each upper shunt relative to the operative rotational direction of the sleeve and a starting point of each lower shunt relative to the operative rotational direction of the sleeve are positioned past a point where the developer mix releases from the outer surface of the sleeve during rotation of the sleeve and above a point where the developer mix reenters the reservoir after releasing from the outer surface of the sleeve.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
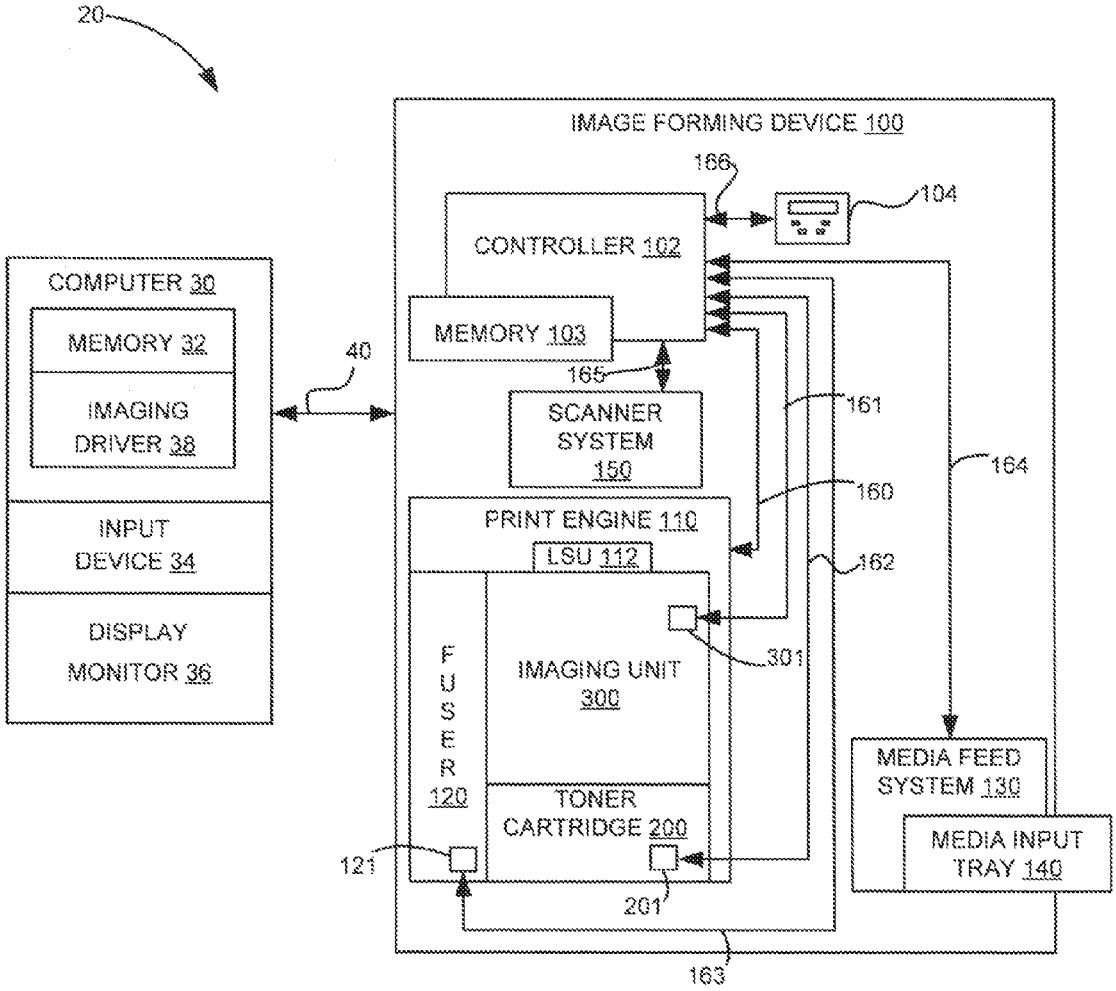
FIG. 1 is a block diagram depiction of an imaging system according to one example embodiment.

Referring now to the drawings and more particularly to FIG. 1, there is shown a block diagram depiction of an imaging system 20 according to one example embodiment. Imaging system 20 includes an image forming device 100 and a computer 30. Image forming device 100 communicates with computer 30 via a communications link 40. As used herein, the term "communications link" generally refers to any structure that facilitates electronic communication between multiple components and may operate using wired or wireless technology and may include communications over the Internet.

In the example embodiment shown in FIG. 1, image forming device 100 is a multifunction machine (sometimes referred to as an all-in-one (AIO) device) that includes a controller 102, a print engine 110, a laser scan unit (LSU) 112, one or more toner bottles or cartridges 200, one or more imaging units 300, a fuser 120, a user interface 104, a media feed system 130 and media input tray 140 and a scanner system 150. Image forming device 100 may communicate with computer 30 via a standard communication protocol, such as, for example, universal serial bus (USB), Ethernet or IEEE 802.xx. Image forming device 100 may be, for example, an electrophotographic printer/copier including an integrated scanner system 150 or a standalone electrophotographic printer.

Controller 102 includes a processor unit and associated memory 103 and may be formed as one or more Application Specific Integrated Circuits (ASICs). Memory 103 may be any volatile or non-volatile memory or combination thereof, such as, for example, random access memory (RAM), read only memory (ROM), flash memory and/or non-volatile RAM (NVRAM). Alternatively, memory 103 may be in the form of a separate electronic memory (e.g., RAM, ROM, and/or NVRAM), a hard drive, a CD or DVD drive, or any memory device convenient for use with controller 102. Controller 102 may be, for example, a combined printer and scanner controller.

In the example embodiment illustrated, controller 102 communicates with print engine 110 via a communications link 160. Controller 102 communicates with imaging unit(s) 300 and processing circuitry 301 on each imaging unit 300 via communications link(s) 161. Controller 102 communicates with toner cartridge(s) 200 and processing circuitry 201 on each toner cartridge 200 via communications link(s) 162. Controller 102 communicates with fuser 120 and processing circuitry 121 thereon via a communications link 163. Controller 102 communicates with media feed system 130 via a communications link 164. Controller 102 communicates with scanner system 150 via a communications link 165. User interface 104 is communicatively coupled to controller 102 via a communications link 166. Processing circuitry 121, 201, 301 may include a processor and associated memory, such as RAM, ROM, and/or NVRAM, and may provide authentication functions, safety and operational interlocks, operating parameters and usage information related to fuser 120, toner cartridge(s) 200 and imaging units 300, respectively. Controller 102 processes print and scan data and operates print engine 110 during printing and scanner system 150 during scanning.

Computer 30, which is optional, may be, for example, a personal computer, including memory 32, such as RAM, ROM, and/or NVRAM, an input device 34, such as a keyboard and/or a mouse, and a display monitor 36. Computer 30 also includes a processor, input/output (I/O) interfaces, and may include at least one mass data storage device, such as a hard drive, a CD-ROM and/or a DVD unit (not shown). Computer 30 may also be a device capable of communicating with image forming device 100 other than a personal computer, such as, for example, a tablet computer, a smartphone, or other electronic device.

In the example embodiment illustrated, computer 30 includes in its memory a software program including program instructions that function as an imaging driver 38, e.g., printer/scanner driver software, for image forming device 100. Imaging driver 38 is in communication with controller 102 of image forming device 100 via communications link 40. Imaging driver 38 facilitates communication between image forming device 100 and computer 30. One aspect of imaging driver 38 may be, for example, to provide formatted print data to image forming device 100, and more particularly to print engine 110, to print an image. Another aspect of imaging driver 38 may be, for example, to facilitate the collection of scanned data from scanner system 150.

In some circumstances, it may be desirable to operate image forming device 100 in a standalone mode. In the standalone mode, image forming device 100 is capable of functioning without computer 30. Accordingly, all or a portion of imaging driver 38, or a similar driver, may be located in controller 102 of image forming device 100 so as to accommodate printing and/or scanning functionality when operating in the standalone mode.

Figure 2:
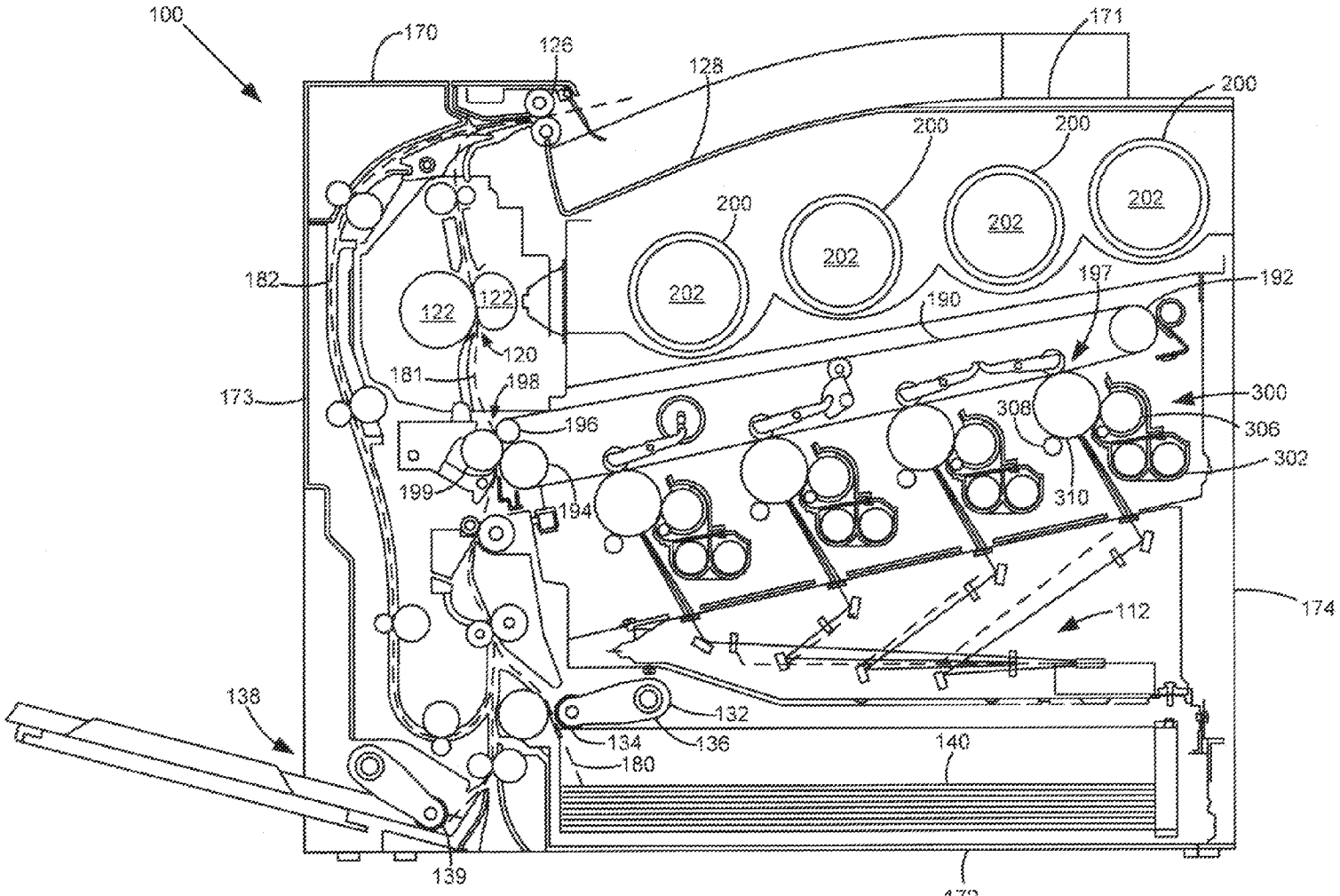
FIG. 2 is a schematic diagram of an image forming device according to one example embodiment.

FIG. 2 illustrates a schematic view of the interior of an example image forming device 100. For purposes of clarity, the components of only one of the imaging units 300 are labeled in FIG. 2. Image forming device 100 includes a housing 170 having a top 171, bottom 172, front 173 and rear 174. Housing 170 includes one or more media input trays 140 positioned therein. Trays 140 are sized to contain a stack of media sheets. As used herein, the term media is meant to encompass not only paper but also labels, envelopes, fabrics, photographic paper or any other desired substrate. Trays 140 are preferably removable for refilling. A media path 180 extends through image forming device 100 for moving the media sheets through the image transfer process. Media path 180 includes a simplex path 181 and may include a duplex path 182. A media sheet is introduced into simplex path 181 from tray 140 by a pick mechanism 132. In the example embodiment shown, pick mechanism 132 includes a roll 134 positioned at the end of a pivotable arm 136. Roll 134 rotates to move the media sheet from tray 140 and into media path 180. The media sheet is then moved along media path 180 by various transport rollers. Media sheets may also be introduced into media path 180 by a manual feed 138 having one or more rolls 139.

In the example embodiment shown, image forming device 100 includes four toner cartridges 200 removably mounted in housing 170 in a mating relationship with four corresponding imaging units 300, which may also be removably mounted in housing 170, Each toner cartridge 200 includes a reservoir 202 for holding toner and an outlet port in communication with an inlet port of its corresponding imaging unit 300 for transferring toner from reservoir 202 to imaging unit 300. Toner is transferred periodically from a respective toner cartridge 200 to its corresponding imaging unit 300 in order to replenish the imaging unit 300. In the example embodiment illustrated, each toner cartridge 200 is substantially the same except for the color of toner contained therein. In one embodiment, the four toner cartridges 200 include yellow, cyan, magenta and black toner.

Image forming device 100 utilizes what is commonly referred to as a dual component development system. Each imaging unit 300 includes a reservoir 302 that stores a mixture of toner and magnetic carrier beads. The carrier beads may be coated with a polymeric film to provide triboelectric properties to attract toner to the carrier beads as the toner and the carrier beads are mixed in reservoir 302. Reservoir 302 and a magnetic roll 306 collectively form a developer unit. Each imaging unit 300 also includes a charge roll 308 and a photoconductive (PC) drum 310 and a cleaner blade or roll (not shown) that collectively form a PC unit. PC drums 310 are mounted substantially parallel to each other when the imaging units 300 are installed in image forming device 100. In the example embodiment illustrated, each imaging unit 300 is substantially the same except for the color of toner contained therein.

Each charge roll 308 forms a nip with the corresponding PC drum 310. During a print operation, charge roll 308 charges the surface of PC drum 310 to a specified voltage, such as, for example, −1000 volts. A laser beam from LSU 112 is then directed to the surface of PC drum 310 and selectively discharges those areas it contacts to form a latent image. In one embodiment, areas on PC drum 310 illuminated by the laser beam are discharged to approximately −300 volts. Magnetic roll 306 attracts the carrier beads in reservoir 302 having toner thereon to magnetic roll 306 through the use of magnetic fields and transports the toner to the corresponding PC drum 310. Electrostatic forces from the latent image on PC drum 310 strip the toner from the carrier beads to form a toner image on the surface of PC drum 310.

An intermediate transfer mechanism (ITM) 190 is disposed adjacent to the PC drums 310. In this embodiment. ITM 190 is formed as an endless belt trained about a drive roll 192, a tension roll 194 and a back-up roll 196. During image forming operations, ITM 190 moves past PC drums 310 in a clockwise direction as viewed in FIG. 2. One or more of PC drums 310 apply toner images in their respective colors to ITM 190 at a first transfer nip 197. In one embodiment, a positive voltage field attracts the toner image from PC drums 310 to the surface of the moving ITM 190, ITM 190 rotates and collects the one or more toner images from PC drums 310 and then conveys the toner images to a media sheet at a second transfer nip 198 formed between a transfer roll 199 and ITM 190, which is supported by back-up roll 196. The cleaner blade/roll removes any toner remnants on PC drum 310 so that the surface of PC drum 310 may be charged and developed with toner again.

A media sheet advancing through simplex path 181 receives the toner image from ITM 190 as it moves through the second transfer nip 198. The media sheet with the toner image is then moved along the media path 180 and into fuser 120. Fuser 120 includes fusing rolls or belts 122 that form a nip to adhere the toner image to the media sheet. The fused media sheet then passes through exit rolls 126 located downstream from fuser 120. Exit rolls 126 may be rotated in either forward or reverse directions. In a forward direction, exit rolls 126 move the media sheet from simplex path 181 to an output area 128 on top 171 of image forming device 100. In a reverse direction, exit rolls 126 move the media sheet into duplex path 182 for image formation on a second side of the media sheet.

While the example image forming device 100 shown in FIG. 2 illustrates four toner cartridges 200 and four corresponding imaging units 300, it will be appreciated that a monocolor image forming device 100 may include a single toner cartridge 200 and corresponding imaging unit 300 as compared to a color image forming device 100 that may include multiple toner cartridges 200 and imaging units 300. Further, although image forming device 100 utilizes ITM 190 to transfer toner to the media, toner may be applied directly to the media by the one or more photoconductive drums 310 as is known in the art. In addition, toner may be transferred directly from each toner cartridge 200 to its corresponding imaging unit 300 or the toner may pass through an intermediate component, such as a chute, duct or hopper, that connects the toner cartridge 200 with its corresponding imaging unit 300.

Imaging unit(s) 300 may be replaceable in any combination desired. For example, in one embodiment, the developer unit and PC unit are provided in separate replaceable units from each other. In another embodiment, the developer unit and PC unit are provided in a common replaceable unit. In another embodiment, toner reservoir 202 is provided with the developer unit instead of in a separate toner cartridge 200. For a color image forming device 100, the developer unit and PC unit of each color toner may be separately replaceable or the developer unit and/or the PC unit of all colors (or a subset of all colors) may be replaceable collectively as desired.

Figure 3:
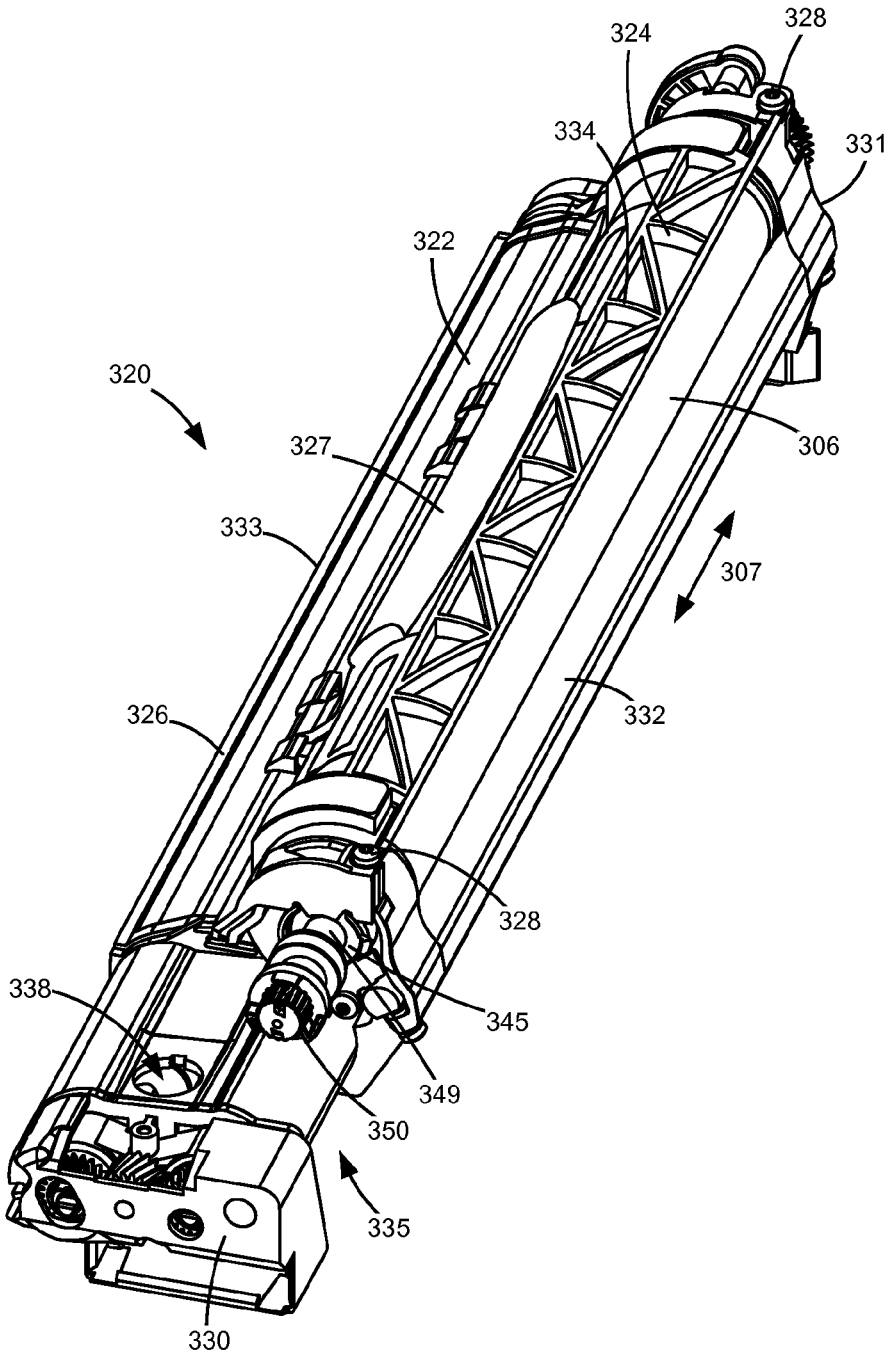
FIG. 3 is a perspective view of a developer unit according to one example embodiment.
Figure 4:
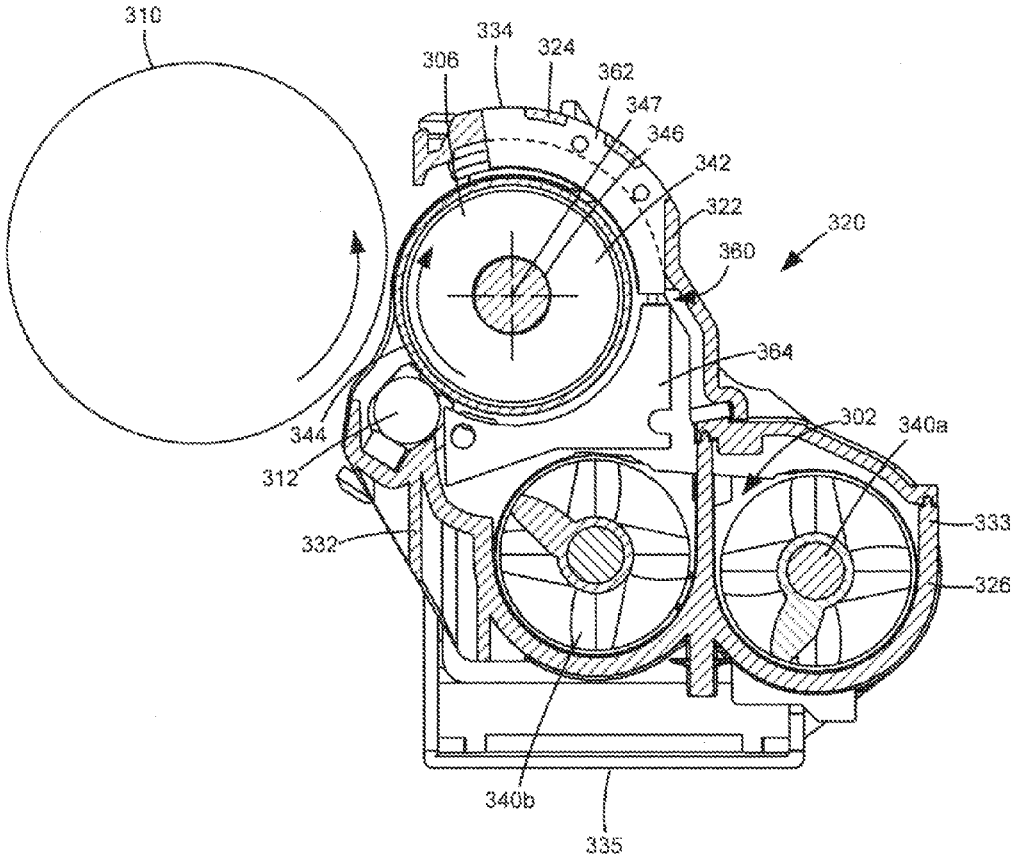
FIG. 4 is a cross-sectional view of the developer unit shown in FIG. 3.

FIGS. 3 and 4 show a developer unit 320 according to one example embodiment. Developer unit 320 includes a housing 322 having reservoir 302 therein. In the example embodiment illustrated, housing 322 includes a lid 324 mounted on a base 326. Lid 324 may be attached to base 326 by any suitable construction including, for example, by fasteners (e.g., screws 328), adhesive and/or welding. Housing 322 extends generally along an axial direction 307 of magnetic roll 306 from a first side 330 of housing 322 to a second side 331 of housing 322. Side 330 leads during insertion of developer unit 320 into image forming device 100. A portion of magnetic roll 306 is exposed at a front 332 of housing 322. A handle 327 is optionally positioned on a rear 333 of housing 322 to assist with separating developer unit 320 from the corresponding PC unit. Housing 322 also includes a top 334 and a bottom 335.

Reservoir 302 holds the mixture of toner and magnetic carrier beads (the "developer mix"). Developer unit 320 includes an inlet port 338 in fluid communication with reservoir 302 and positioned to receive toner from toner cartridge 200 to replenish reservoir 302 when the toner concentration in reservoir 302 relative to the amount of carrier beads remaining in reservoir 302 gets too low as toner is consumed from reservoir 302 by the printing process. In the example embodiment illustrated, inlet port 338 is positioned on top 334 of housing 322 near side 330; however, inlet port 338 may be positioned at any suitable location on housing 322.

Reservoir 302 includes one or more agitators to stir and move the developer mix. For example, in the embodiment illustrated, reservoir 302 includes a pair of augers 340*a*, 340*b*. Augers 340*a*, 340*b* are arranged to move the developer mix in opposite directions along the axial length of magnetic roll 306. For example, auger 340*a* is positioned to incorporate toner from inlet port 338 and to move the developer mix away from side 330 and toward side 331, Auger 340*b* is positioned to move the developer mix away from side 331, in proximity to the bottom of magnetic roll 306 and toward side 330. This arrangement of augers 340*a*, 340*b* is sometimes informally referred to as a racetrack arrangement because of the circular path the developer mix in reservoir 302 takes when augers 340*a*, 340*b* rotate.

With reference to FIG. 4, magnetic roll 306 includes a core 342 that includes one or more permanent magnets and does not rotate relative to housing 322. A cylindrical sleeve 344 encircles core 342 and extends along the axial length of magnetic roll 306, Sleeve 344 has a greater axial length than core 342 such that axial end portions of sleeve 344 extend past both axial ends of core 342, A shaft 346 passes through the center of core 342 and defines an axis of rotation 347 of magnetic roll 306. Shaft 346 is fixed, i.e., shaft 346 does not rotate with sleeve 344 relative to housing 322, and controls the position of core 342 relative to sleeve 344. With reference back to FIG. 3, a rotatable end cap 345 is positioned at one axial end of magnetic roll 306, referred to as the drive side of magnetic roll 306. End cap 345 is coupled to sleeve 344 such that rotation of end cap 345 causes sleeve 344 to rotate around core 342. Sleeve 344 rotates in a clockwise direction as viewed in FIG. 4 to transfer toner from reservoir 302 to PC drum 310. A drive coupler 350 is operatively connected to end cap 345 either directly, such as on an end of a shaft 349 that extends axially outward from end cap 345 as shown in the example embodiment illustrated, or indirectly. Drive coupler 350 is positioned to receive rotational force from a corresponding drive coupler in image forming device 100 when developer unit 320 is installed in image forming device 100. Any suitable drive coupler 350 may be used as desired, such as a toothed gear or a drive coupler that receives rotational force at its axial end. In one embodiment, augers 340*a*, 340*b* are operatively connected to drive coupler 350 by one or more intermediate gears (not shown). Alternatively, augers 340*a*, 340*b* may be driven independently of drive coupler 350 and sleeve 344 by a second drive coupler positioned to receive rotational force from a corresponding drive coupler in image forming device 100 when developer unit 320 is installed in image forming device 100.

Figure 5:
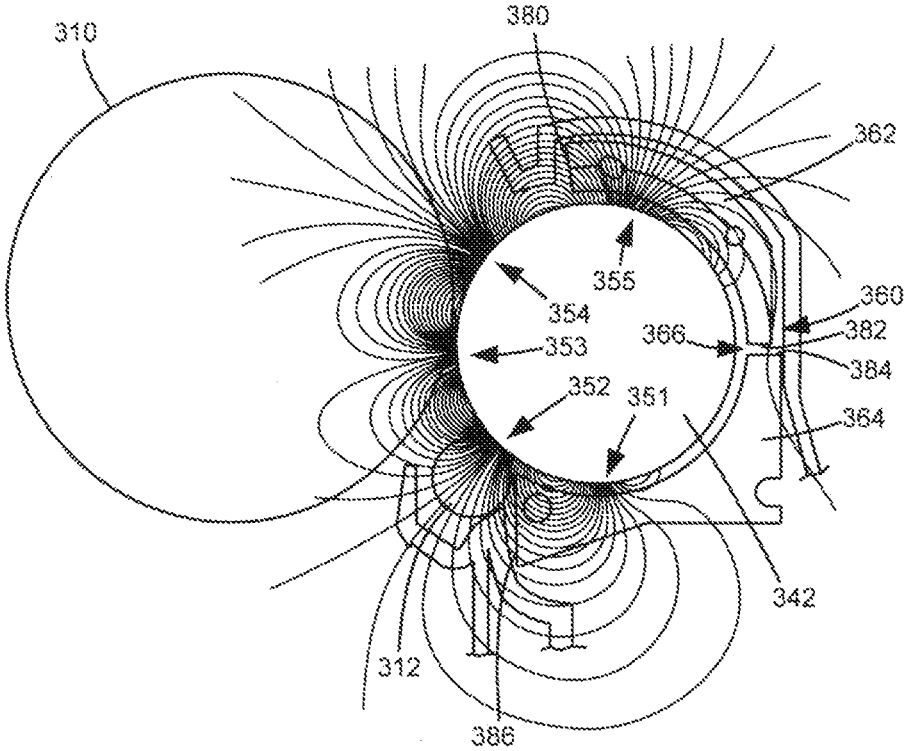
FIG. 5 is a schematic diagram of the developer unit of FIGS. 3 and 4 showing the magnetic field lines of a magnetic roll according to one example embodiment.

With reference to FIGS. 4 and 5, the permanent magnet(s) of core 342 include a series of circumferentially spaced, alternating (south v. north) magnetic poles that facilitate the transfer of toner to PC drum 310 as sleeve 344 rotates. FIG. 5 shows the magnetic field lines generated by the magnetic poles of core 342 according to one example embodiment. Core 342 includes a pickup pole 351 positioned near the bottom of core 342 (near the 6:00 position of core 342 as viewed in FIG. 5). Pickup pole 351 magnetically attracts developer mix in reservoir 302 to the outer surface of sleeve 344. The magnetic attraction from core 342 causes the developer mix to form bristle-like chains that extend from the outer surface of sleeve 344 along the magnetic field lines. In one embodiment, the outer surface of sleeve 344 includes a series of radially indented grooves or is otherwise roughened. The grooves extend axially along the outer surface of sleeve 344 and are spaced circumferentially from each other about the outer surface of sleeve 344. The surface roughness of sleeve 344 promotes the formation of chains of developer mix with the bases of the chains tending to form in the grooves and minimizes slipping of the developer mix on the outer surface of sleeve 344.

After the developer mix is picked up at pickup pole 351, as sleeve 344 rotates, the developer mix on sleeve 344 advances toward a trim bar 312. Trim bar 312 is positioned in close proximity to the outer surface of sleeve 344. Trim bar 312 trims the chains of developer mix as they pass to a predetermined height defined by the gap between trim bar 312 and the outer surface of sleeve 344 in order to control the amount of developer mix on sleeve 344. The surface roughness of the outer surface of sleeve 344 helps the developer mix pass trim bar 312. Trim bar 312 may be magnetic or non-magnetic and may take a variety of different shapes including having a flat or rounded trimming surface. Core 342 includes a trim pole 352 positioned at trim bar 312 to stand the chains of developer mix up on sleeve 344 in a generally radial orientation for trimming by trim bar 312. As shown in FIG. 5, between pickup pole 351 and trim pole 352, the chains of developer mix on sleeve 344 have a primarily tangential (as opposed to radial) orientation relative to the outer surface of sleeve 344 according to the magnetic field lines between pickup pole 351 and trim pole 352.

As sleeve 344 rotates further, the developer mix on sleeve 344 passes in close proximity to the outer surface of PC drum 310. As discussed above, electrostatic forces from the latent image formed on PC drum 310 by the laser beam from LSU 112 strip the toner from the carrier beads to form a toned image on the surface of PC drum 310. Core 342 includes a developer pole 353 positioned at the point where the outer surface of sleeve 344 passes in close proximity to the outer surface of PC drum 310 to once again stand the chains of developer mix up on sleeve 344 in a generally radial orientation to promote the transfer of toner from sleeve 344 to PC drum 310. The developer mix is less dense and less coarse when the chains of developer mix are stood up in a generally radial orientation than it is when the chains are more tangential. As a result, less wear occurs on the surface of PC drum 310 from contact between PC drum 310 and the chains of developer mix when the chains of developer mix on sleeve 344 are in a generally radial orientation.

As sleeve 344 continues to rotate, the remaining developer mix on sleeve 344, including the toner not transferred to PC drum 310 and the carrier beads, is carried by magnetic roll 306 past PC drum 310 and back toward reservoir 302. Core 342 includes a transport pole 354 positioned past the point where the outer surface of sleeve 344 passes in close proximity to the outer surface of PC drum 310. Transport pole 354 magnetically attracts the remaining developer mix to sleeve 344 to prevent the remaining developer mix from migrating to PC drum 310 or otherwise releasing from sleeve 344. As sleeve 344 rotates further, the remaining developer mix passes under lid 324 and is carried back to reservoir 302 by magnetic roll 306. Core 342 includes a release pole 355 positioned near the top of core 342 along the direction of rotation of sleeve 344. Release pole 355 magnetically attracts the remaining developer mix to sleeve 344 as the developer mix is carried the remaining distance to the point where it is released back into reservoir 302. As the remaining developer mix passes the 2:00 position of core 342 as viewed in FIG. 5, the developer mix is no longer magnetically retained against sleeve 344 by core 342 allowing the developer mix to fall via gravity and centrifugal force back into reservoir 302. The surface roughness of the outer surface of sleeve 344 helps sleeve 344 retain the developer mix as the developer mix passes release pole 355 to the point where the developer mix is released back into reservoir 302.

Figure 6:
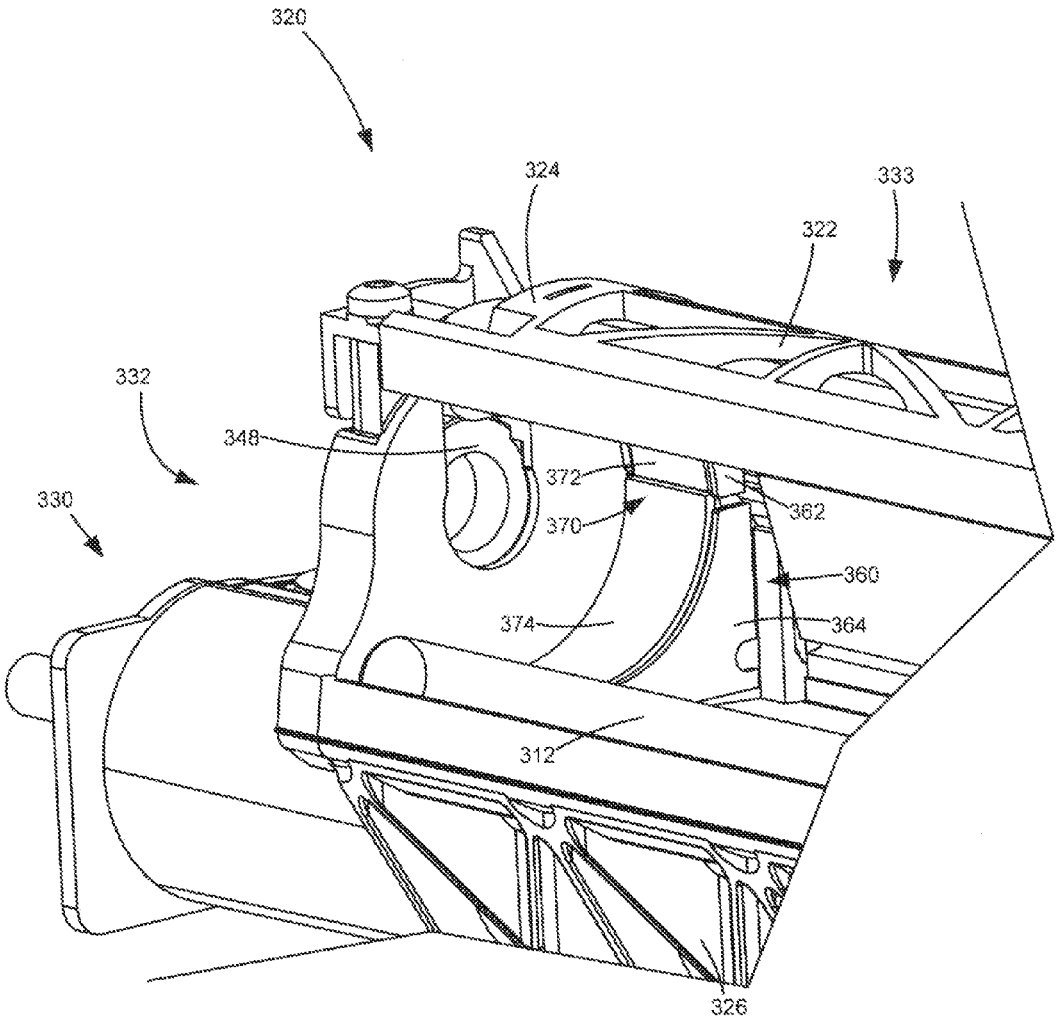
FIG. 6 is a perspective view of an end of the developer unit of FIGS. 3-5 with the magnetic roll removed according to one example embodiment.

FIG. 6 shows an end portion of developer unit 320 near side 330 with magnetic roll 306 removed to more clearly illustrate the components positioned within housing 322 near the axial end of magnetic roll 306. A bushing 348 is positioned at each axial end of magnetic roll 306 that receives a respective axial end of shaft 346. Bushings 348 locate the ends of shaft 346.

An external magnetic shunt assembly 360 that axially truncates the magnetic field at the axial ends of core 342 is positioned axially outboard of core 342, just past each axial end of core 342, in close proximity to a portion of the outer surface of sleeve 344 near each axial end of sleeve 344. Magnetic shunt assemblies 360 are referred to as external because they are In positioned outside of sleeve 344. In the example embodiment illustrated, each shunt assembly 360 includes an upper magnetic shunt 362 and a lower magnetic shunt 364 as discussed in greater detail below, Each shunt 362, 364 is composed of a magnetically permeable metal that pulls or redirects the magnetic field lines from the axial ends of core 342 back into core 342 to decrease the distance that the magnetic field lines extend axially past core 342. As a result, shunts 362, 364 decrease how far out axially the chains of developer mix form on the outer surface of sleeve 344. In this manner, shunts 362, 364 limit the amount of developer mix on sleeve 344 axially past the ends of core 342 and permit the use of a sleeve 344 having a smaller overall axial length as well as a charge roll 308 and PC drum 310 having smaller axial lengths. The reduction of developer mix past the axial ends of core 342 reduces the amount of toner that is inadvertently transferred to the outer axial portions of PC drum 310 beyond the axial ends of charge roll 308 thereby improving the print quality at the side margins of the printed page and improving toner yield by reducing the amount of toner lost to the outer axial portions of PC drum 310. In one embodiment, the permeability of each shunt is at least 10 times the permeability of free space and may be between 100 and 1,000 times the permeability of free space or more.

During operation, the magnetic field lines redirected by shunts 362, 364 at the axial ends of magnetic roll 306 cause a wall of developer mix to accumulate in the gaps between the outer surface of sleeve 344 and shunts 362, 364. The wall of developer mix forms a barrier to reduce the developer mix leaking axially outward from magnetic roll 306 or reservoir 302 and out of housing 322 at the axial ends of magnetic roll 306 during operation or in the event that developer unit 320 is dropped.

A magnetic seal assembly 370 is positioned in close proximity to a portion of the outer surface of sleeve 344 at each axial end of magnetic roll 306, axially outboard of the magnetic shunt assembly 360 at each axial end of magnetic roll 306, In the example embodiment illustrated, each seal assembly 370 includes an upper magnetic seal 372 positioned axially outboard from upper shunt 362 and a lower magnetic seal 374 positioned axially outboard from lower shunt 364. In one embodiment, a thin plastic rib separates upper shunt 362 from upper magnetic seal 372 and lower shunt 364 from lower magnetic seal 374 at each axial end of magnetic roll 306. Magnetic seals 372, 374 each include a permanent magnet that attracts any developer mix that leaks axially outward past shunts 362, 364 to reduce the developer mix leaking out of housing 322 at the axial ends of magnetic roll 306 during operation or in the event that developer unit 320 is dropped. Developer mix may tend to initially accumulate on the inner axial portions of magnetic seals 372, 374 creating a barrier that reduces the developer mix leaking further axially outward. In one embodiment, the permanent magnet of each magnetic seal 372, 374 includes a series of alternating (south v. north) magnetic poles that are axially offset from each other.

With reference to FIGS. 4-6, in the example embodiment illustrated, upper shunts 362 and magnetic seals 372 are mounted on an inner surface of lid 324 proximate to the outer surface of sleeve 344 and lower shunts 364 and magnetic seals 374 are mounted on an inner surface of base 326 proximate to the outer surface of sleeve 344. Shunts 362, 364 and magnetic seals 372, 374 curve around sleeve 344 in close proximity to the outer surface of sleeve 344. Each upper shunt 362 is axially aligned with its corresponding lower shunt 364 and each upper magnetic seal 372 is axially aligned with its corresponding lower magnetic seal 374. In the example embodiment illustrated, a starting point 380 (with respect, to the direction of rotation of sleeve 344), or front end, of upper shunts 362 and magnetic seals 372 is positioned between transport pole 354 and release pole 355 where the magnetic field from core 342 is more tangential than radial. In this region of the magnetic field, the chains of developer mix are more parallel to the outer surface of sleeve 344 than perpendicular to the outer surface of sleeve 344 as the chains of developer mix encounter starting point 380 of upper shunt 362 and magnetic seal 372. As a result, less shearing of the chains of developer mix occurs at starting point 380 than if starting point 380 of upper shunts 362 and magnetic seals 372 was positioned where the magnetic field from core 342 is more radial than tangential where the chains of developer mix stand up more on the outer surface of sleeve 344. If too much developer mix sheared at starting point 380 of upper shunts 362 and magnetic seals 372, developer mix may tend to accumulate on the front edge of upper shunts 362 and/or magnetic seals 372 potentially causing leakage from the front 332 of housing 322. In one embodiment, starting point 380 of upper shunts 362 and magnetic seals 372 is positioned at about the peak tangential point of the magnetic field from core 342 between transport pole 354 and release pole 355.

An ending point 382 (with respect to the direction of rotation of sleeve 344), or bottom end, of upper shunts 362 and magnetic seals 372 and a starting point 384 (with respect to the direction of rotation of sleeve 344), or top end, of lower shunts 364 and magnetic seals 374 are positioned past the point where developer mix releases from the outer surface of sleeve 344 during rotation of sleeve 344. Ending point 382 and starting point 384 are positioned above the point where the released developer mix reenters reservoir 302 (at about the top 334 of housing 322 above auger 340*a*), higher than the top of trim bar 312. As a result, the released developer mix tends to fall from sleeve 344 toward reservoir 302 as it passes ending point 382 and starting point 384, and may fall substantially vertically at about the 3:00 position of magnetic roll 306 as viewed in FIG. 5 (where the tangent to the outer surface of sleeve 344 is vertical) as it passes ending point 382 and starting point 384, In one embodiment, a small gap 366 (e.g., ~1 mm) exists between ending point 382 of each upper shunt 362 and magnetic seal 372 and starting point 384 of each lower shunt 364 and magnetic seal 374. Gaps 366 are positioned at the point where the developer mix released from sleeve 344 falls substantially vertically toward reservoir 302 at about the 3:00 position of magnetic roll 306 as viewed in FIG. 5 thereby reducing the likelihood of developer mix leaking through gap 366. Further, the magnetic fields of upper magnetic seals 372 and lower magnetic seals 374, regardless of their orientation (e.g., both north both south, or one south and one north), tend to curve over and magnetically fill gaps 366 thereby also reducing the likelihood of leakage through gaps 366.

An ending point 386 (with respect to the direction of rotation of sleeve 344), or front end, of lower shunts 364 and magnetic seals 374 is positioned in close proximity to trim bar 312. In one embodiment, a front end of each lower magnetic seal 374 touches the rear side of trim bar 312 to reduce leakage of developer mix between trim bars 312 and lower magnetic seal 374.

In the embodiment illustrated, the combination of each upper shunt 362 and lower shunt 364 and the combination of each upper magnetic seal 372 and lower magnetic seal 374 surround greater than 180 degrees of the outer surface of sleeve 344 from starting point 380 to ending point 386. For example, in one embodiment, the combination of each upper shunt 362 and lower shunt 364 and the combination of each upper magnetic seal 372 and lower magnetic seal 374 surround between 200 degrees and 260 degrees including all increments and values therebetween, such as about 221 degrees, of the outer surface of sleeve 344.

Figure 7:
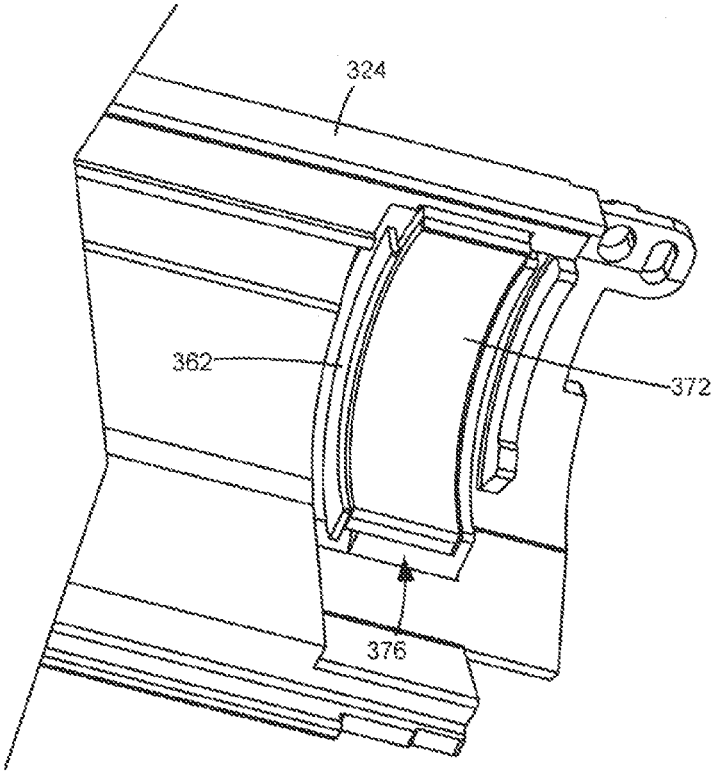
FIG. 7 is a perspective view of an inner side of a lid of the developer unit of FIGS. 3-6 according to one example embodiment.
Figure 8:
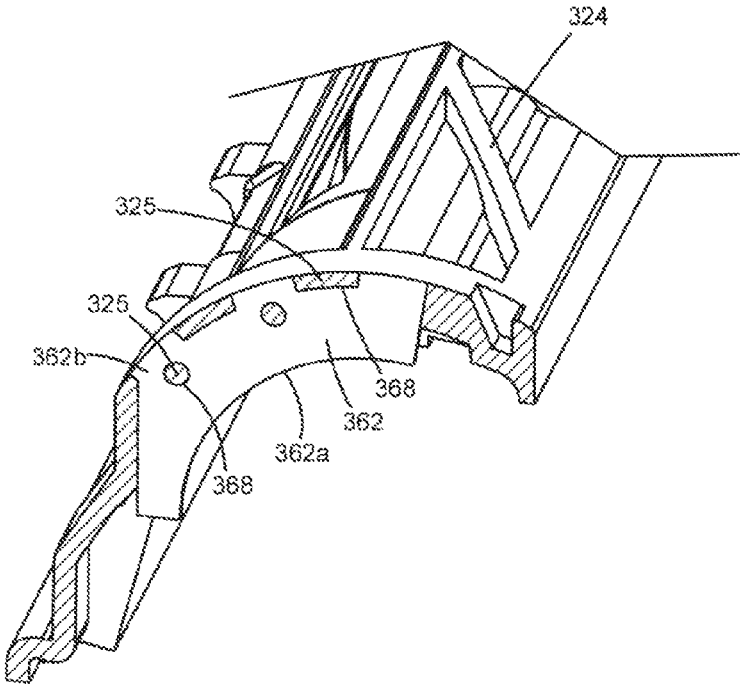
FIG. 8 is a cross-sectional view of the lid of the developer unit shown in FIG. 7 showing a magnetic shunt insert molded into the lid according to one example embodiment.

With reference to FIGS. 7 and 8, in one embodiment, each upper shunt 362 is insert molded into a plastic lid 324 of housing 320. In this embodiment, a distal portion 362*a* of shunt 362 in proximity to the outer surface of sleeve 344 is exposed on the inner surface of lid 324 from starting point 380 to ending point 382. A proximate portion 362*b* of shunt 362 is retained in lid 324, As shown in FIG. 8, in one example embodiment, shunt 362 includes retention holes 368 that are filled in with corresponding retention posts 325 on lid 324 during the molding process. The engagement between retention holes 368 and posts 325 enables precise positioning of shunt 362. In other embodiments, shunt 362 is attached to lid 324 by other suitable methods, such as by adhesive, fasteners, friction fit, etc. Lower shunts 364 are also attached by any suitable method, such as by insert molding, adhesive, fasteners, etc. Upper shunts 362 and lower shunts 364 may be attached by the same method or shunts 362 may be attached to lid 324 differently than shunts 364 to base 326.

With reference to FIG. 7, in one embodiment, each magnetic seal 372, 374 is attached by an adhesive to an inner surface of lid 324 and base 326 of housing 322, respectively. In the example embodiment illustrated, magnetic seals 372, 374 are each matably received in a recessed mounting pocket 376 on the inner surface of lid 324 and of base 326, respectively. Mounting pockets 376 have a curved shape that matches the curvature of magnetic seals 372, 374. In other embodiments, magnetic seals 372, 374 are mounted by other suitable means, such as by fasteners, friction fit, etc. Magnetic seals 372, 374 may be composed of a flexible resin binder loaded with magnetic particles. The flexible resin binder may be manufactured flat and then bent upon attachment to housing 322.

Figure 9:
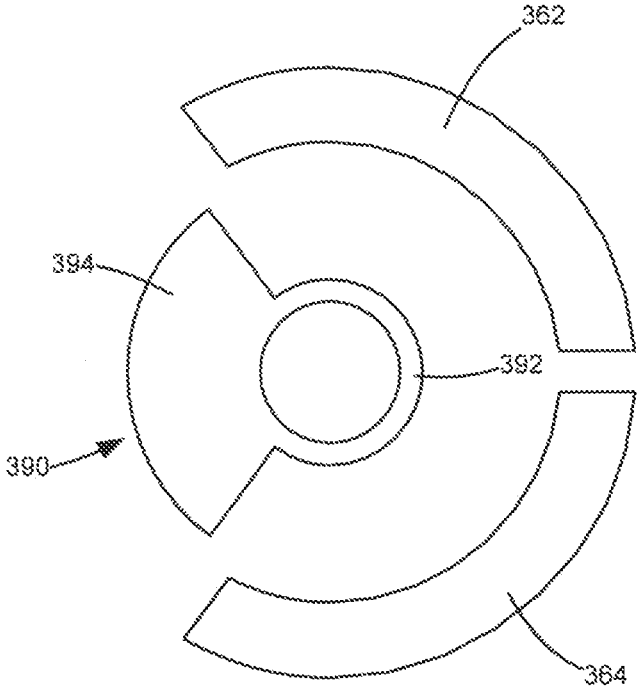
FIG. 9 is a schematic diagram of an arrangement of an external magnetic shunt and an internal magnetic shunt according to a first example embodiment.
Figure 10:
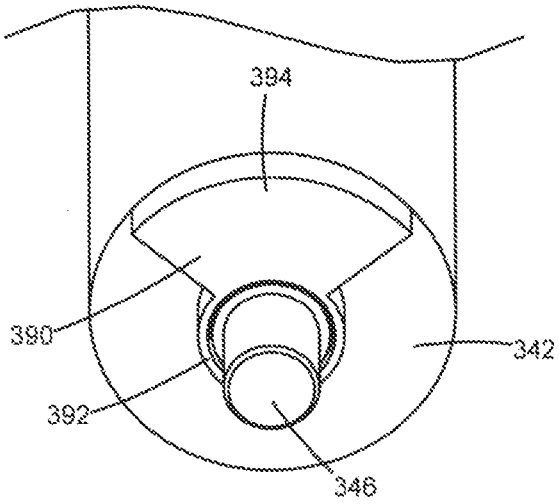
FIG. 10 is a perspective end view of a magnetic roll core having the internal shunt shown in FIG. 9 installed on a shaft of the magnetic roll core according to one example embodiment.

With reference to FIGS. 9 and 10, in some embodiments, magnetic roll 306 includes an internal magnetic shunt 390 at each axial end of magnetic roll 306. Internal shunts 390 are positioned against opposite axial ends of core 342 inside of sleeve 344. Magnetic shunts 390 are referred to as internal because they are positioned inside of sleeve 344. External shunts 362, 364 and internal shunts 390 combine to axially truncate the magnetic field at the axial ends of core 342 around substantially the entire circumference of magnetic roll 306. Internal shunts 390 redirect the magnetic field of core 342 along the area where magnetic roll 306 is exposed on the front 332 of housing 322, where toner is transferred from magnetic roll 306 to PC drum 310, at the axial ends of magnetic roll 306. In one embodiment, each internal shunt 390 includes a thin (in the radial direction) circular ring 392 that fits around shaft 346. FIG. 10 shows one of the internal shunts 390 positioned against one axial end of core 342 with ring 392 positioned around shaft 346. Internal shunts 390 do not rotate with sleeve 344 relative to housing 322. In one embodiment, each internal shunt 390 is fixed to the axial end of core 342 and/or to shaft 346, such as by adhesive, keying or friction fit, in order to prevent the internal shunt 390 from rotating.

Each internal shunt 390 also includes a shunt portion 394 that extends in the radial direction to a position in close proximity to the inner surface of sleeve 344 at the radial edge of core 342. Shunt portions 394 are composed of a magnetically permeable metal that pulls or redirects the magnetic field lines from the axial ends of core 342 back into core 342 as discussed above with respect to shunts 362, 364. As a result, internal shunts 390 decrease how far out axially the chains of developer mix form on the outer surface of sleeve 344 to limit the amount of developer mix on sleeve 344 axially past the ends of core 342. In one embodiment, the permeability of each shunt portion 394 is at least 10 times the permeability of free space and may be between 100 and 1,000 times the permeability of free space or more. As shown in FIG. 9, each shunt portion 394 is positioned along the circumferential portion of magnetic roll 306 that shunts 362, 364 cannot reach without interfering with the toner transfer from magnetic roll 306 to PC drum 310. For example, where the combination of upper shunts 362 and lower shunts 364 surrounds 220 degrees of magnetic roll 306, each shunt portion 394 is positioned along substantially all of the remaining 140 degrees of magnetic roll 306. The shunt portion 394 at each axial end of magnetic roll 306 does not overlap angularly with the external shunts 362, 364 at that axial end of magnetic roll 306. If a shunt portion 394 did overlap with one or more of the external shunts 362, 364, the shunt portion 394 would tend to cancel out the magnetic field truncation of the overlapped shunt 362 and/or 364 thereby defeating the purpose of the internal shunt 390 and the external shunts 362, 364 in the overlapping region.

Figure 11:
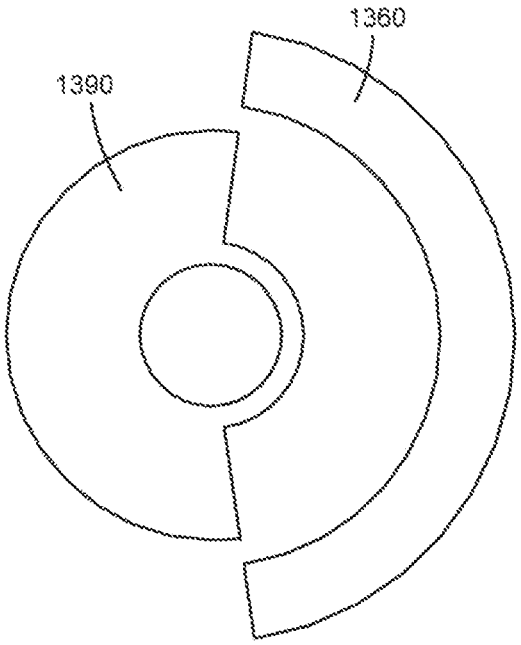
FIG. 11 is a schematic diagram of an arrangement of an external magnetic shunt and an internal magnetic shunt according to a second example embodiment.

The example embodiment shown in FIGS. 9 and 10 shows each internal shunt 390 positioned in combination with an upper external shunt 362 and a lower external shunt 364 to provide axial magnetic field truncation along substantially the entire circumferential dimension of core 342 at a respective axial end of core 342. However, any suitable combination of one or more external shunts and one or more internal shunts may be used at each axial end of core 342. Each internal shunt(s) and external shunt(s) may be positioned along any suitable circumferential portion of core 342 on long as the external shunt(s) do not interfere with the toner transfer from magnetic roll 306 to PC drum 310. For example, FIG. 11 shows a combination of an internal shunt 1390 and an external shunt 1360 according to another example embodiment. In this embodiment, an internal shunt 1390 is positioned along more than 180 degrees of core 342 at each axial end of magnetic roll 306 while an external shunt 1360 surrounds less than 180 degrees of sleeve 344 at each axial end of magnetic roll 306. The combination of internal shun t(s) and external shunt(s) may be positioned along substantially the entire circumferential dimension of core 342 or less than the entire circumferential dimension of core 342 as desired.

The foregoing description illustrates various aspects and examples of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A developer unit for a dual component development electrophotographic image forming device, comprising:

a housing having a reservoir for storing a developer mix that includes toner and magnetic carrier beads;

a magnetic roll including a stationary core and a sleeve positioned around the core that is rotatable relative to the core about an axis of rotation, the stationary core includes at least one permanent magnet having a plurality of circumferentially spaced magnetic poles, an outer surface of the sleeve is positioned to carry developer mix attracted to the outer surface of the sleeve by the at least one permanent magnet from the reservoir through an exposed portion of the magnetic roll and back to the reservoir, in the exposed portion of the magnetic roll the magnetic roll is exposed from the reservoir to permit transfer of toner from the outer surface of the sleeve to a photoconductive drum; and an upper shunt and a lower shunt positioned at each axial end of the magnetic roll, each upper and lower shunt is composed of a magnetically permeable metal that redirects a magnetic field of the at least one permanent magnet at a respective axial end of the magnetic roll, each upper shunt and each lower shunt is positioned axially outboard of the core and in close proximity to the outer surface of the sleeve, each upper shunt is positioned along an upper circumferential portion of the outer surface of the sleeve and each lower shunt is positioned along a lower circumferential portion of the outer surface of the sleeve, wherein a combination of the upper shunt and the lower shunt at each axial end of the magnetic roll surrounds greater than 180 degrees of the outer surface of the sleeve.

2. The developer unit of claim 1, further comprising an upper magnetic seal and a lower magnetic seal positioned at each axial end of the magnetic roll, each upper magnetic seal and each lower magnetic seal is positioned axially outboard of the respective upper and lower shunt at the axial end of the magnetic roll where said upper magnetic seal or lower magnetic seal is positioned, each upper magnetic seal and each lower magnetic seal is positioned in close proximity to the outer surface of the sleeve, each upper magnetic seal is positioned along the upper circumferential portion of the outer surface of the sleeve and each lower magnetic seal is positioned along the lower circumferential portion of the outer surface of the sleeve, each upper and lower magnetic seal includes a permanent magnet that attracts developer mix to the respective upper or lower magnetic seal.

3. The developer unit of claim 2, further comprising a trim bar for trimming the developer mix on the outer surface of the sleeve, the trim bar is positioned in close proximity to the outer surface of the sleeve between where the developer mix is attracted from the reservoir to the outer surface of the sleeve and where the outer surface of the sleeve passes the exposed portion of the magnetic roll, wherein an ending point of each lower magnetic seal relative to the operative rotational direction of the sleeve is positioned in close proximity to the trim bar.

4. The developer unit of claim 2, wherein an ending point of each upper magnetic seal relative to an operative rotational direction of the sleeve and a starting point of each lower magnetic seal relative to the operative rotational direction of the sleeve are positioned at about a position where a tangent to the rotational path of the outer surface of the sleeve is vertical when the developer unit is in its operative orientation.

5. The developer unit of claim 1, wherein an ending point of each upper shunt relative to an operative rotational direction of the sleeve and a starting point of each lower shunt relative to the operative rotational direction of the sleeve are positioned past a point where the developer mix releases from the outer surface of the sleeve during rotation of the sleeve and above a point where the developer mix reenters the reservoir after releasing from the outer surface of the sleeve.

6. The developer unit of claim 5, wherein a starting point of each upper shunt relative to the operative rotational direction of the sleeve is positioned circumferentially between a pair of poles of the plurality of circumferentially spaced magnetic poles where a magnetic field from the at least one permanent magnet is more tangential than radial.

7. The developer unit of claim 6, further comprising a trim bar for trimming the developer mix on the outer surface of the sleeve, the trim bar is positioned in close proximity to the outer surface of the sleeve between where the developer mix is attracted from the reservoir to the outer surface of the sleeve and where the outer surface of the sleeve passes the exposed portion of the magnetic roll, wherein an ending point of each lower shunt relative to the operative rotational direction of the sleeve is positioned in close proximity to the trim bar.

8. The developer unit of claim 1, further comprising a trim bar for trimming the developer mix on the outer surface of the sleeve, the trim bar is positioned in close proximity to the outer surface of the sleeve between where the developer mix is attracted from the reservoir to the outer surface of the sleeve and where the outer surface of the sleeve passes the exposed portion of the magnetic roll, wherein an ending point of each upper shunt relative to an operative rotational direction of the sleeve and a starting point of each lower shunt relative to the operative rotational direction of the sleeve are positioned higher than a top of the trim bar when the developer unit is in its operative orientation.

9. The developer unit of claim 1, wherein an ending point of each upper shunt relative to an operative rotational direction of the sleeve and a starting point of each lower shunt relative to the operative rotational direction of the sleeve are positioned at about a position where a tangent to the rotational path of the outer surface of the sleeve is vertical when the developer unit is in its operative orientation.

10. The developer unit of claim 1, wherein the combination of the upper shunt and the lower shunt at each axial end of the magnetic roll surrounds between 200 degrees and 260 degrees of the outer surface of the sleeve.

11. The developer unit of claim 1, wherein the housing includes a lid attached to a base of the housing, the upper shunts are mounted on an inner surface of the lid and the lower shunts are mounted on an inner surface of the base.

12. The developer unit of claim 11, wherein the upper shunts are insert molded into the lid.

13. The developer unit of claim 11, further comprising an upper magnetic seal and a lower magnetic seal positioned at each axial end of the magnetic roll, each upper magnetic seal and each lower magnetic seal is positioned axially outboard of the respective upper and lower shunt at the axial end of the magnetic roll where said upper magnetic seal or lower magnetic seal is positioned, each upper magnetic seal and each lower magnetic seal is positioned in close proximity to the outer surface of the sleeve, each upper magnetic seal is positioned along the upper circumferential portion of the outer surface of the sleeve and each lower magnetic seal is positioned along the lower circumferential portion of the outer surface of the sleeve, each upper and lower magnetic seal includes a permanent magnet that attracts developer mix to the respective upper or lower magnetic seal, each upper magnetic seal is mounted on the inner surface of the lid and each lower magnetic seal is mounted on the inner surface of the base.

14. A developer unit for a dual component development electrophotographic image forming device, comprising:

a housing having a reservoir for storing a developer mix that includes toner and magnetic carrier beads;

a magnetic roll including a stationary core and a sleeve positioned around the core that is rotatable relative to the core about an axis of rotation, the stationary core includes at least one permanent magnet having a plurality of circumferentially spaced magnetic poles, an outer surface of the sleeve is positioned to carry developer mix attracted to the outer surface of the sleeve by the at least one permanent magnet from the reservoir through an exposed portion of the magnetic roll and back to the reservoir, in the exposed portion of the magnetic roll the magnetic roll is exposed from the reservoir to permit transfer of toner from the outer surface of the sleeve to a photoconductive drum; and an upper shunt and a lower shunt positioned at each axial end of the magnetic roll, each upper and lower shunt is composed of a magnetically permeable metal that redirects a magnetic field of the at least one permanent magnet at a respective axial end of the magnetic roll, each upper shunt and each lower shunt is positioned axially outboard of the core and in close proximity to the outer surface of the sleeve, each upper shunt is positioned along an upper circumferential portion of the outer surface of the sleeve and each lower shunt is positioned along a lower circumferential portion of the outer surface of the sleeve, a starting point of each upper shunt relative to an operative rotational direction of the sleeve is positioned circumferentially between a pair of poles of the plurality of circumferentially spaced magnetic poles where a magnetic field from the at least one permanent magnet is more tangential than radial, an ending point of each upper shunt relative to the operative rotational direction of the sleeve and a starting point of each lower shunt relative to the operative rotational direction of the sleeve are positioned past a point where the developer mix releases from the outer surface of the sleeve during rotation of the sleeve and above a point where the developer mix reenters the reservoir after releasing from the outer surface of the sleeve.

15. The developer unit of claim 14, further comprising an upper magnetic seal and a lower magnetic seal positioned at each axial end of the magnetic roll, each upper magnetic seal and each lower magnetic seal is positioned axially outboard of the respective upper and lower shunt at the axial end of the magnetic roll where said upper magnetic seal or lower magnetic seal is positioned, each upper magnetic seal and each lower magnetic seal is positioned in close proximity to the outer surface of the sleeve, each upper magnetic seal is positioned along the upper circumferential portion of the outer surface of the sleeve and each lower magnetic seal is positioned along the lower circumferential portion of the outer surface of the sleeve, each upper and lower magnetic seal includes a permanent magnet that attracts developer mix to the respective upper or lower magnetic seal.

16. The developer unit of claim 15, further comprising a trim bar for trimming the developer mix on the outer surface of the sleeve, the trim bar is positioned in close proximity to the outer surface of the sleeve between where the developer mix is attracted from the reservoir to the outer surface of the sleeve and where the outer surface of the sleeve passes the exposed portion of the magnetic roll, wherein an ending point of each lower magnetic seal relative to the operative rotational direction of the sleeve is positioned in close proximity to the trim bar.

17. The developer unit of claim 15, wherein an ending point of each upper magnetic seal relative to the operative rotational direction of the sleeve and a starting point of each lower magnetic seal relative to the operative rotational direction of the sleeve are positioned at about a position where a tangent to the rotational path of the outer surface of the sleeve is vertical when the developer unit is in its operative orientation.

18. The developer unit of claim 14, further comprising a trim bar for trimming the developer mix on the outer surface of the sleeve, the trim bar is positioned in close proximity to the outer surface of the sleeve between where the developer mix is attracted from the reservoir to the outer surface of the sleeve and where the outer surface of the sleeve passes the exposed portion of the magnetic roll, wherein an ending point of each lower shunt relative to the operative rotational direction of the sleeve is positioned in close proximity to the trim bar.

19. The developer unit of claim 14, further comprising a trim bar for trimming the developer mix on the outer surface of the sleeve, the trim bar is positioned in close proximity to the outer surface of the sleeve between where the developer mix is attracted from the reservoir to the outer surface of the sleeve and where the outer surface of the sleeve passes the exposed portion of the magnetic roll, wherein the ending point of each upper shunt relative to the operative rotational direction of the sleeve and the starting point of each lower shunt relative to the operative rotational direction of the sleeve are positioned higher than a top of the trim bar when the developer unit is in its operative orientation.

20. The developer unit of claim 14, wherein the ending point of each upper shunt relative to the operative rotational direction of the sleeve and the starting point of each lower shunt relative to the operative rotational direction of the sleeve are positioned at about a position where a tangent to the rotational path of the outer surface of the sleeve is vertical when the developer unit is in its operative orientation.

21. The developer unit of claim 14, wherein a combination of the upper shunt and the lower shunt at each axial end of the magnetic roll surrounds between 200 degrees and 260 degrees of the outer surface of the sleeve.

22. The developer unit of claim 14, wherein the housing includes a lid attached to a base of the housing, the upper shunts are mounted on an inner surface of the lid and the lower shunts are mounted on an inner surface of the base.

23. The developer unit of claim 22, wherein the upper shunts are insert molded into the lid.

24. The developer unit of claim 22, further comprising an upper magnetic seal and a lower magnetic seal positioned at each axial end of the magnetic roll, each upper magnetic seal and each lower magnetic seal is positioned axially outboard of the respective upper and lower shunt at the axial end of the magnetic roll where said upper magnetic seal or lower magnetic seal is positioned, each upper magnetic seal and each lower magnetic seal is positioned in close proximity to the outer surface of the sleeve, each upper magnetic seal is positioned along the upper circumferential portion of the outer surface of the sleeve and each lower magnetic seal is positioned along the lower circumferential portion of the outer surface of the sleeve, each upper and lower magnetic seal includes a permanent magnet that attracts developer mix to the respective upper or lower magnetic seal, each upper magnetic seal is mounted on the inner surface of the lid and each lower magnetic seal is mounted on the inner surface of the base.

25. A developer unit for a dual component development electrophotographic image forming device, comprising:

a housing having a reservoir for storing a developer mix that includes toner and magnetic carrier beads;

a magnetic roll including a stationary core and a sleeve positioned around the core that is rotatable relative to the core about an axis of rotation, the stationary core includes at least one permanent magnet having a plurality of circumferentially spaced magnetic poles, an outer surface of the sleeve is positioned to carry developer mix attracted to the outer surface of the sleeve by the at least one permanent magnet from the reservoir through an exposed portion of the magnetic roll and back to the reservoir, in the exposed portion of the magnetic roll the magnetic roll is exposed from the reservoir to permit transfer of toner from the outer surface of the sleeve to a photoconductive drum; and an upper shunt and a lower shunt positioned at each axial end of the magnetic roll, each upper and lower shunt is composed of a magnetically permeable metal that redirects a magnetic field of the at least one permanent magnet at a respective axial end of the magnetic roll, each upper shunt and each lower shunt is positioned axially outboard of the core and in close proximity to the outer surface of the sleeve, each upper shunt is positioned along an upper circumferential portion of the outer surface of the sleeve and each lower shunt is positioned along a lower circumferential portion of the outer surface of the sleeve, a starting point of each upper shunt relative to an operative rotational direction of the sleeve is positioned circumferentially between a pair of poles of the plurality of circumferentially spaced magnetic poles where a magnetic field from the at least one permanent magnet is more tangential than radial, an ending point of each upper shunt relative to the operative rotational direction of the sleeve and a starting point of each lower shunt relative to the operative rotational direction of the sleeve are positioned at about a position where a tangent to the rotational path of the outer surface of the sleeve is vertical when the developer unit is in its operative orientation.

* * * * *

UNITED STATES PATENT AND TRADEMARK OFFICE

CERTIFICATE OF CORRECTION

PATENT NO. : 9,188,907 B1
APPLICATION NO. : 14/536800
DATED : November 17, 2015
INVENTOR(S) : Robert Dan Bennett et al.

It is certified that error appears in the above-identified patent and that said Letters Patent is hereby corrected as shown below:

On The Title Page, Item (54), Title, replace "DUAL ELECTROPHOTOGRAPHIC" with --DUAL COMPONENT DEVELOPMENT ELECTROPHOTOGRAPHIC--.

Signed and Sealed this
First Day of March, 2016

Michelle K. Lee

Michelle K. Lee
*Director of the United States Patent and Trademark Office*